US007428393B2

(12) United States Patent
Hosokawa et al.

(10) Patent No.: US 7,428,393 B2
(45) Date of Patent: Sep. 23, 2008

(54) DEVELOPING DEVICE, PROCESS CARTRIDGE, DEVICE UNIT, AND IMAGE FORMING APPARATUS HAVING A SEALING MEMBER

(75) Inventors: Hiroshi Hosokawa, Kanagawa (JP); Atsushi Sampe, Kanagawa (JP); Yoshiyuki Kimura, Tokyo (JP); Hiroyuki Nagashima, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 7 days.

(21) Appl. No.: 11/019,424

(22) Filed: Dec. 23, 2004

(65) Prior Publication Data

US 2005/0158071 A1 Jul. 21, 2005

(30) Foreign Application Priority Data

Dec. 25, 2003 (JP) ..... 2003-429284

(51) Int. Cl.
*G03G 15/08* (2006.01)

(52) U.S. Cl. ..... 399/103

(58) Field of Classification Search ..... 399/103, 399/102, 105, 106

See application file for complete search history.

(56) References Cited

U.S. PATENT DOCUMENTS 5,264,901 A * 11/1993 Rossiter ..... 399/105
5,475,469 A 12/1995 Okada et al.
5,486,909 A 1/1996 Takenaka et al.
5,489,747 A 2/1996 Takenaka et al.
5,552,870 A 9/1996 Murakami et al.
5,617,191 A 4/1997 Murakami et al.
5,625,438 A 4/1997 Sugiyama et al.
5,625,440 A 4/1997 Matsumae et al.
5,625,441 A 4/1997 Sugiyama et al.
5,627,630 A 5/1997 Matsumae et al.
5,666,625 A 9/1997 Komatsubara et al.
5,689,782 A 11/1997 Murakami et al.
5,697,026 A 12/1997 Matsumae et al.

(Continued)

FOREIGN PATENT DOCUMENTS

CN 1441326 A 9/2003

(Continued)

OTHER PUBLICATIONS

U.S. Appl. No. 11/287,305, filed Nov. 28, 2005, Hosokawa et al.

*Primary Examiner*—David M. Gray
*Assistant Examiner*—Ruth N LaBombard
(74) *Attorney, Agent, or Firm*—Oblon, Spivak, McClelland, Maier & Neustadt, P.C.

(57) ABSTRACT

A highly reliable developing device, process cartridge, device unit, and image forming apparatus in which a developer is not spattered to the outside of the developing device even when the developing device where a developer is preset is included with shipment in an image forming apparatus main body. This developing device comprises a developer container for containing a developer, and a toner replenishing portion which is connected with a toner conveyance portion installed in the image forming apparatus main body and which is communicated with the developer container via an opening portion. Such a developing device is provided with a sealing member for sealing the opening portion until use of the developing device on the image forming apparatus main body is started.

41 Claims, 6 Drawing Sheets

U.S. PATENT DOCUMENTS

| | | | | |
|---|---|---|---|---|
| 5,708,942 | A | 1/1998 | Sugiyama et al. | |
| 5,819,145 | A | 10/1998 | Tanaka et al. | |
| 5,826,144 | A | 10/1998 | Takenaka et al. | |
| 5,845,183 | A | 12/1998 | Sugiyama et al. | |
| 5,879,752 | A | 3/1999 | Murakami et al. | |
| 5,991,569 | A | 11/1999 | Sugihara et al. | |
| 6,033,818 | A | 3/2000 | Sugiyama et al. | |
| 6,072,967 | A | 6/2000 | Sugihara et al. | |
| 6,266,501 | B1 | 7/2001 | Mizuishi et al. | |
| 6,560,431 | B2 | 5/2003 | Hosokawa | |
| 6,564,029 | B2 * | 5/2003 | Kojima et al. | 399/106 |
| 6,658,226 | B2 * | 12/2003 | Wang et al. | 399/258 |
| 6,687,474 | B2 | 2/2004 | Yamada et al. | |
| 2001/0043826 | A1 * | 11/2001 | Mizoguchi et al. | 399/106 |
| 2003/0099481 | A1 | 5/2003 | Sampe et al. | |
| 2004/0047650 | A1 | 3/2004 | Nagashima | |
| 2004/0096239 | A1 | 5/2004 | Hosokawa et al. | |
| 2004/0126139 | A1 | 7/2004 | Yoshizawa et al. | |
| 2004/0170446 | A1 | 9/2004 | Nagashima et al. | |
| 2004/0170447 | A1 | 9/2004 | Arai et al. | |
| 2004/0184841 | A1 * | 9/2004 | Tsuda et al. | 399/258 |
| 2004/0223782 | A1 | 11/2004 | Hosokawa et al. | |
| 2004/0223790 | A1 | 11/2004 | Hosokawa et al. | |
| 2005/0158071 | A1 | 7/2005 | Hosokawa et al. | |
| 2005/0271424 | A1 * | 12/2005 | Zemba | 399/254 |

FOREIGN PATENT DOCUMENTS

| | | | |
|---|---|---|---|
| EP | 0 661 608 | A2 | 7/1995 |
| EP | 1 403 733 | A1 | 3/2004 |
| JP | 02-110584 | | 4/1990 |
| JP | 4-477 | | 1/1992 |
| JP | 04-084156 | | 3/1992 |
| JP | 05-289512 | | 11/1993 |
| JP | 2531931 | | 1/1997 |
| JP | 2761158 | | 3/1998 |
| JP | 10-123837 | | 5/1998 |
| JP | 10-293451 | | 11/1998 |
| JP | 11-030905 | | 2/1999 |
| JP | 2927828 | | 5/1999 |
| JP | 2987083 | | 10/1999 |
| JP | 2000-181210 | | 6/2000 |
| JP | 2000-187382 | | 7/2000 |
| JP | 2000-315007 | | 11/2000 |
| JP | 2000-347504 | | 12/2000 |
| JP | 2001-75364 | | 3/2001 |
| JP | 2001-222157 | | 8/2001 |
| JP | 2002-072681 | | 3/2002 |
| JP | 3356249 | | 10/2002 |
| JP | 2002-341638 | | 11/2002 |
| JP | 3434116 | | 5/2003 |
| JP | 2003-223044 | | 8/2003 |

* cited by examiner

DEVELOPING DEVICE, PROCESS CARTRIDGE, DEVICE UNIT, AND IMAGE FORMING APPARATUS HAVING A SEALING MEMBER

BACKGROUND OF THE INVENTION

1. Field of the Invention

The present invention relates to a developing device detachably installed in the main body of an image forming apparatus, a process cartridge comprising this developing device, a device unit, and the image forming apparatus, and particularly relates to a developing device included with shipment in the image forming apparatus main body, with a developer contained therein.

2. Description of the Related Art

In an image forming apparatus, such as a copier, printer, facsimile machine, or complex machine thereof, which uses an electrophotographic system, Japanese Laid-Open Application No. H10-123837 (Page 2, FIG. 6) discloses a conventional technology where a shipment of a developing device is made in a state where the developing device having a developer contained therein beforehand is installed in an image forming apparatus main body, for the purpose of simplifying the packaging system at the time of factory shipment, and of simplifying the unpacking work which is carried out after a user receives the apparatus. Specifically, when a service person or a user himself/herself unpacks an image forming apparatus at a place where he/she happens to be, e.g. installation place, the work of placing a developer in the developing device or in the process cartridge is a burden for the person who unpacks it. In order to solve this problem, a shipment is made in a state where the developer is contained in the developing device beforehand. The act of placing a developer beforehand in the developing device or in the process cartridge when making shipment is appropriately called "presetting" in the present invention.

Further, when packaging the developing device or process cartridge separating from the packaging of the image forming apparatus main body, work efficiency of unpacking by an unpacking worker deteriorates, and also packaging cost or transportation cost increases. In order to solve these problems, the developing device or process cartridge is installed in the image forming apparatus main body, is packaged along with the image forming apparatus main body to make a shipment.

On the other hand, the abovementioned Japanese Laid-Open Application No. H10-123837 discloses a technology in which a surface of a developing roller is covered with a shutter or the like so that, when presetting the developer in the developing device, a developer contained in a developing device does not leak out of an opening which faces a photosensitive drum and from which a part of the developing roller is exposed.

In the conventional image forming apparatus, however, sometimes the developer preset in the developing device is spattered inside the image forming apparatus main body due to a shock or the like applied to the image forming apparatus between when the image forming apparatus was shipped and when it was transported to the user. If the developer contained in the developing device is spattered to the outside of the apparatus, as described above, there occur problems such that the inside of the image forming apparatus main body is stained, impairing functions of various components therein, and the necessary amount of the developer for carrying out the development process cannot be ensured, thus the image quality of an output image is degraded. Therefore, these problems cannot be ignored in providing a highly reliable image forming apparatus.

As disclosed in the abovementioned Japanese Laid-Open Application No. H10-123837, these problems might occur even in an image forming apparatus in which a surface of a developing roller in a developing device is sealed with a shutter or the like. In other words, the developer contained in the developer apparatus might be spattered inside the image forming apparatus main body through a toner conveyance portion of the apparatus main body, the toner conveyance portion being connected to a toner replenishing portion of the developing device. The details are as follows.

Specifically, for the purpose of obtaining a long life developing device, and for some other purposes, a lot of image forming apparatuses comprise a toner conveyance portion for supplying a toner into the developing device. In such an image forming apparatus, the toner is conveyed from the toner conveyance portion of the apparatus main body to a toner replenishing portion of the developing device. The toner replenishing portion of the developing device is communicated with a developer container containing a developer via an opening portion. The toner that is conveyed to the toner replenishing portion is then supplied into the developer container.

Here, the toner replenishing portion of the developing device and the toner conveyance portion of the apparatus main body are configured so as to be freely brought into contact with and separated from each other. Further, the toner replenishing portion and the toner conveyance portion respectively have installed therein shutters that are opened and closed simultaneously with an operation of attaching or detaching the developer apparatus to or from the apparatus main body. When the developer apparatus is attached to the apparatus main body, the toner replenishing portion and toner conveyance portion are connected, and the shutters of both toner replenishing portion and toner conveyance portion are opened so that the toner can be replenished from the toner conveyance portion to the toner replenishing portion. On the other hand, when the developing device is detached from the apparatus main body, the toner replenishing portion and toner conveyance portion are disconnected, and the both shutters are closed so that toner spattering from the toner conveyance portion and developer spattered from the toner replenishing portion are prevented.

In the image forming apparatus with such a configuration, when packaging the image forming apparatus with the developing device installed in the image forming apparatus main body and shipping this package, the toner replenishing portion of the developing device and the toner conveyance portion of the apparatus main body are connected, and the both shutters are opened. In this state therefore, when presetting the developer at the time of shipment, the developer contained in the developer container inside of the developing device flows back from the opening portion to the toner conveyance portion through the toner replenishing portion and is spattered, due to a shock applied to the developing device during transport.

SUMMARY OF THE INVENTION

The present invention is contrived to solve such problems as described above, thus it is an object of the present invention to provide a highly reliable developing device, process cartridge, device unit, and image forming apparatus, in which a developer is not spattered to the outside of the developing device even when the developing device with the developer preset therein is included with shipment in a main body of the image forming apparatus.

In accordance with the present invention, a developing device comprises a developer container for containing a developer, a toner replenishing portion which is connected with a toner conveyance portion installed in an image forming apparatus main body and is communicated with the developer container via an opening portion, and a sealing member for sealing the opening portion until the developing device is used on the image forming apparatus main body.

In accordance with the present invention, an image forming apparatus main body is equipped with a developing device. The developing device comprises a developer container for containing a developer, a toner replenishing portion which is connected with a toner conveyance portion installed in the image forming apparatus main body and is communicated with the developer container via an opening portion, and a sealing member for sealing the opening portion until the developing device is used on the image forming apparatus main body.

In accordance with the present invention, a developing device and image supporting body are integrated in a process cartridge which is installed detachably to an image forming apparatus main body. The developing device comprises a developer container for containing a developer, a toner replenishing portion which is connected with a toner conveyance portion installed in the image forming apparatus main body and is communicated with the developer container via an opening portion, and a sealing member for sealing the opening portion until the developing device is used on the image forming apparatus main body.

In accordance with then present invention, an image forming apparatus main body is equipped with a process cartridge. The process cartridge is installed detachably to the image forming apparatus main body.

In accordance with the present invention, a device unit is installed detachably to an image forming apparatus main body and is equipped with a developing device. The developing device comprises a developer container for containing a developer, a toner replenishing portion which is connected with a toner conveyance portion installed in an image forming apparatus main body and is communicated with the developer container via an opening portion, and a sealing member for sealing the opening portion until the developing device is used on the image forming apparatus main body. At least one of an image supporting body, charge portion for charging the top of the image supporting body, transfer portion for transferring a toner image formed on the image supporting body to a transfer receiving material, and cleaning portion for cleaning on the image supporting body is integrated with the developing device.

In accordance with the present invention, an image forming apparatus main body is equipped with a device unit which is installed detachably to the image forming apparatus main body and is equipped with a developing device. The developing device comprises a developer container for containing a developer, a toner replenishing portion which is connected with a toner conveyance portion installed in an image forming apparatus main body and is communicated with the developer container via an opening portion, and a sealing member for sealing the opening portion until the developing device is used on said image forming apparatus main body. At least one of an image supporting body, charge portion for charging the top of the image supporting body, transfer portion for transferring a toner image formed on the image supporting body to a transfer receiving material, and cleaning portion for cleaning on the image supporting body is integrated with the developing device.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT(S)

Figure 1:
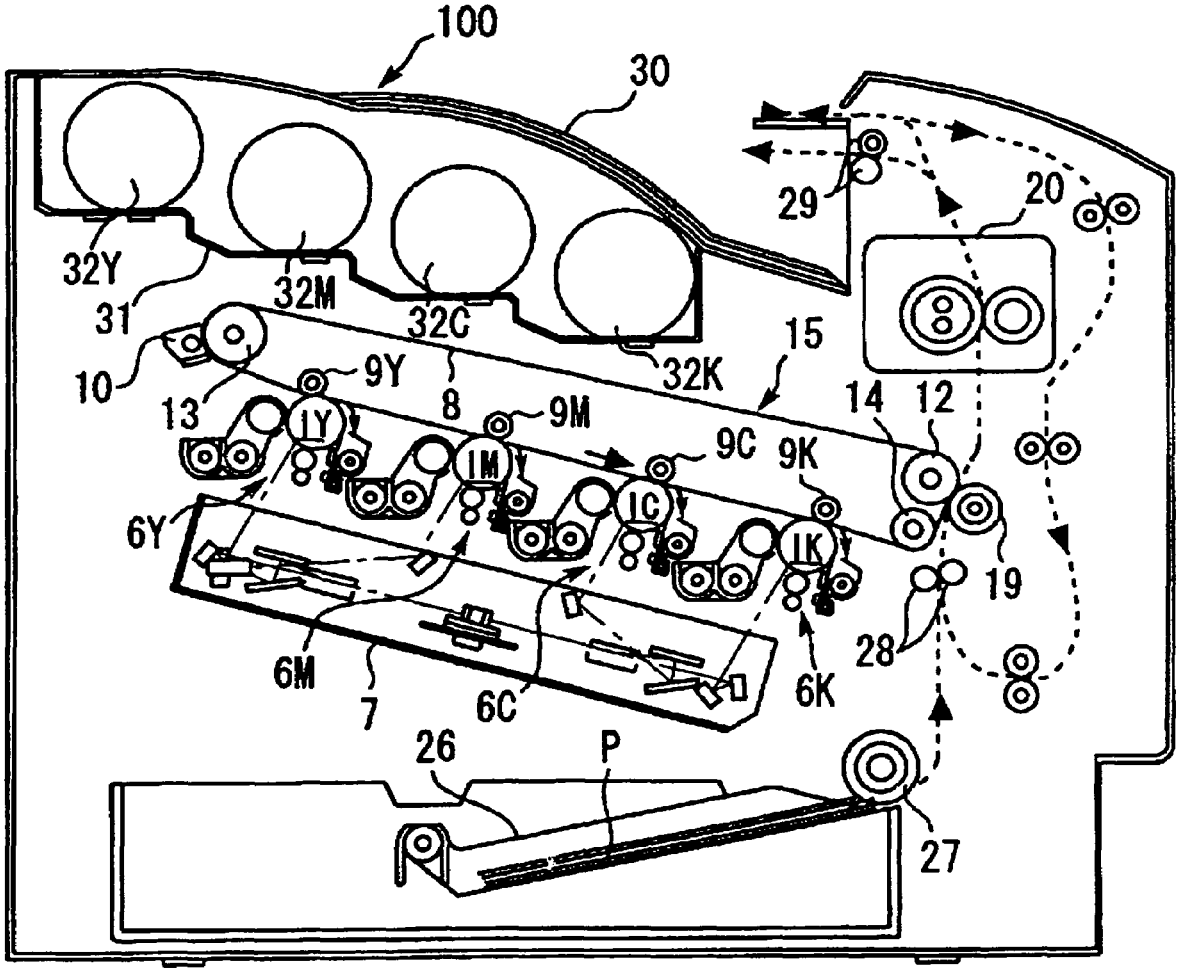
FIG. 1 is a figure showing an entire configuration of an image forming apparatus in an embodiment of the present invention.

An embodiment of the present invention will now be described in detail hereinbelow with reference to the figures. Note, in each figure, that like reference characters are used to indicate the same or like portions, thus the overlapping explanations are simplified or omitted accordingly.

Figure 2:
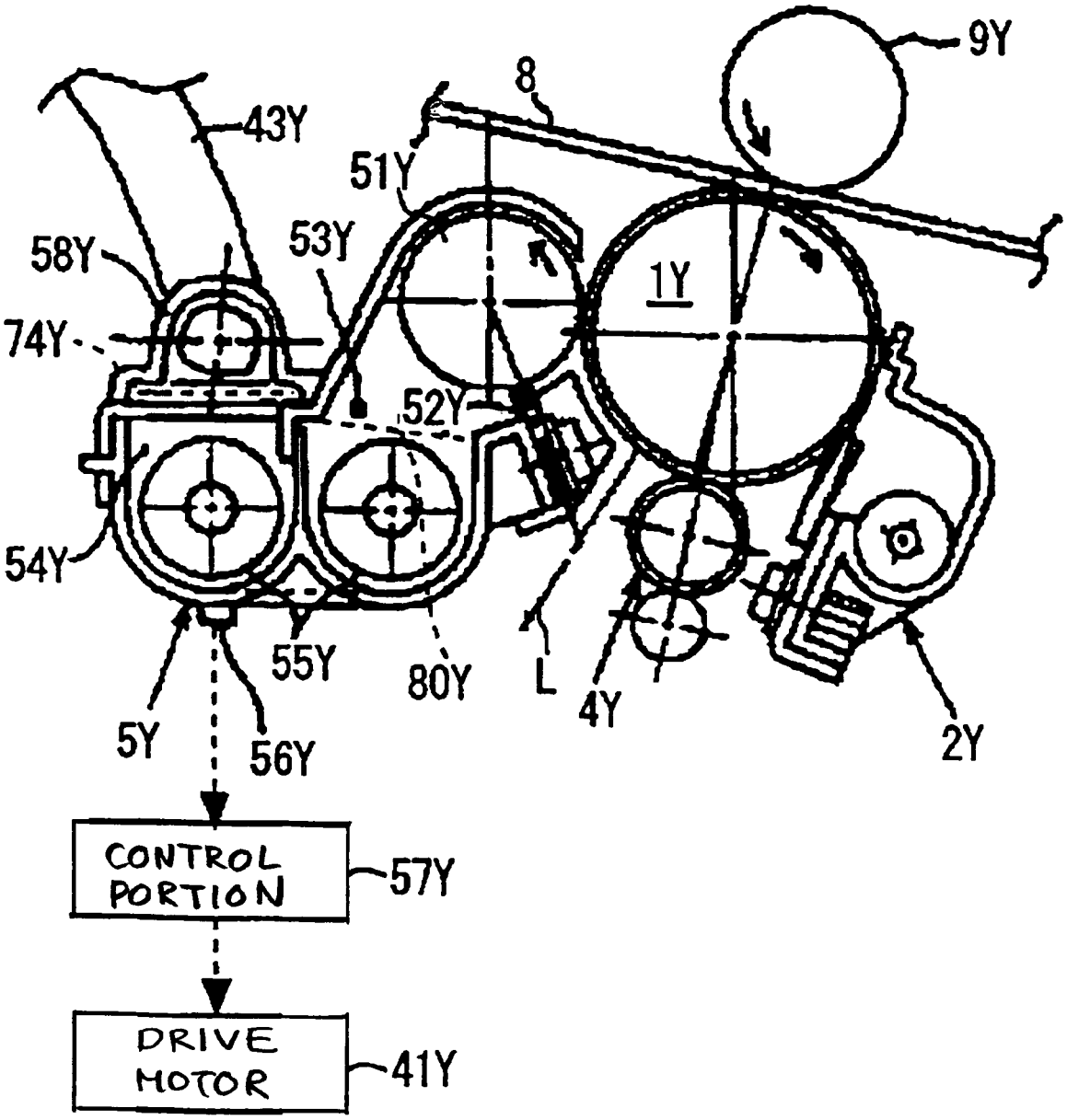
FIG. 2 is a cross-sectional view showing a configuration of an image creating portion of the image forming apparatus.

First of all, the composition and operation of the entire image forming apparatus are described using FIG. 1 and FIG. 2.

FIG. 1 is a configuration diagram showing a printer as an image forming apparatus, and FIG. 2 is an expanded diagram showing an image creating portion of the printer. As shown in FIG. 1, image creating portions 6Y, 6M, 6C and 6K respectively accommodating colors (yellow, magenta, cyan, and black) are arranged so as to face a intermediate transfer belt 8 of a intermediate transfer unit 15. As shown in FIG. 2, the image creating portion 6Y accommodating yellow comprises a photosensitive drum 1Y serving as an image supporting body, a charge portion 4Y disposed in the circumference of the photosensitive drum 1Y, a developing device 5Y, a cleaning portion 2Y, a neutralizing portion (not shown) and the like. Further, an image creation process (i.e. a charging process, exposure process, development process, transfer process, cleaning process, etc) is carried out on the photosensitive drum 1Y, thereby forming a yellow image on the photosensitive drum 1Y.

The other three image creating portions 6M, 6C and 6K also have substantially the same composition as the image creating portion 6Y accommodating yellow, except that the toner colors to be used are different, thus images accommodating the respective toner colors are formed. Therefore, explanations about these three image creating portions 6M, 6C and 6K are omitted, and only the image creating portion 6Y accommodating yellow is described.

The photosensitive drum 1Y, charging portion 4Y, developing device 5Y, and cleaning portion 2Y that constitute the image creating portion 6Y respectively have configurations in which they can be installed detachably with respect to an image forming apparatus main body 100. These are replaced with new ones when they reach the end of their usefulness.

In the present embodiment, although the photosensitive drum 1Y, charging portion 4Y, developing device 5Y, and cleaning portion 2Y that constitute the image creating portion 6Y are taken as independent units respectively, it is possible to integrate these portions to make a process cartridge to be installed detachably in the apparatus main body 100.

As shown in FIG. 2, the photosensitive drum 1Y is rotary driven in the clockwise direction in FIG. 2 by a drive portion which is not shown. A surface of the photosensitive drum 1Y is uniformly charged at a position of the charging portion 4Y (the charging process). Thereafter, the surface of the photosensitive drum 1Y reaches an irradiation position of a laser beam L emitted from an exposure device 7, and an electrostatic latent image accommodating yellow is formed by performing exposure scanning at this position (the exposure process). The surface of the photosensitive drum 1Y then reaches a position to face the developing device 5Y, the electrostatic latent image is developed at this position, and a toner image accommodating yellow is formed (the development process).

The surface of the photosensitive drum 1Y is then reaches a position to face the intermediate transfer belt 8 and a first transfer bias roller 9Y, and the toner image on the photosensitive drum 1Y is transferred onto the intermediate transfer belt 8 at this position (a first transfer process). At this point, untransferred toner slightly remains on the photosensitive drum 1Y. The surface of the photosensitive drum 1Y then reaches a position to face the cleaning portion 2Y, and the untransferred toner remaining on the photosensitive drum 1Y is recovered at this position (the cleaning process).

Finally, the surface of the photosensitive drum 1Y reaches a position to face the neutralizing portion, which is not shown, and the residual potential on the photosensitive drum 1Y is removed at this position.

In this manner, the line of the image creation process which is performed on the photosensitive drum 1Y is completed.

The image creation process described above is performed in the other image creating portions 6M, 6C and 6K as well in a similar way to the yellow,image creating portion 6Y. Specifically, from the exposure portion 7 disposed on the lower side of the image creating portion, the laser beam L on the basis of the image information is emitted onto the photosensitive drums of the respective image creating portions 6M, 6C and 6K. Specifically, in the exposure portion 7, the light source emits the laser beam L, which is then emitted onto the photosensitive drum through a plurality of optical elements while being scanned by a rotary driven polygon mirror. Thereafter, the toner images width different colors that are formed on the respective photosensitive drum by going through the development process are lapped on top of another and transferred onto the intermediate transfer belt 8. Consequently a color image is formed on the intermediate transfer belt 8.

At this point, the intermediate transfer unit 15 is constituted by the intermediate transfer belt 8, four first transfer bias rollers 9Y, 9M, 9C and 9K, a second transfer backup roller 12, cleaning backup roller 13, tension roller 14, intermediate transfer cleaning portion 10 and the like. The intermediate transfer belt 8 is extended and supported by the three rollers 12 to 14 and is moved endlessly in the direction of the arrow in FIG. 1 by rotation drive of one of the rollers, i.e. the roller 12. Each of the four first transfer bias rollers 9Y, 9M, 9C and 9K forms a first transfer nip by having the intermediate transfer belt 8 interposed between the first transfer bias rollers and the photosensitive drums 1Y, 1M, 1C and 1K. The first transfer bias rollers 9Y, 9M, 9C and 9K are subjected to a transfer bias having a polarity opposite with a polarity of the toner. The transfer belt 8 then travels in the direction of the arrow and passes the first transfer nips of the respective first transfer bias rollers 9Y, 9M, 9C and 9K sequentially. Consequently, the toner images with different colors on the respective photosensitive drums 1Y, 1M, 1C and 1K are lapped on top of another and subjected to first transfer onto the intermediate transfer belt 8.

The intermediate transfer belt 8 onto which the toner images with different colors are lapped on top of another and transferred then reaches a position opposite to a second transfer roller 19. In this position the second transfer backup roller 12 forms a second transfer nip by having the intermediate transfer belt 8 interposed between the second transfer backup roller 12 and the second transfer roller 19. Each of the four toner images formed on the intermediate transfer belt 8 is transferred onto a transfer receiving member P, such as transfer paper, which is conveyed to the position of the second transfer nip. At this point, toner that was not transferred onto the transfer receiving member P remains on the intermediate transfer belt 8. The intermediate transfer belt 8 reaches a position of the intermediate transfer cleaning portion 10. The untransferred toner on the intermediate transfer belt 8 is then recovered in this position.

In this manner the line of the transfer process which is performed on the intermediate transfer belt 8 is completed.

The transfer receiving member P conveyed to the position of the second transfer nip is obtained by being conveyed from a paper feeding portion 26 disposed on the lower side of the apparatus main body 100 via a paper feed roller 27, a pair of resist rollers 28 and the like. Specifically, a plurality of the transfer receiving members P, such as transfer paper and the like, are lapped on top of another and stored in the paper feeding portion 26. Further, when the paper feed roller 27 is rotary driven in the counterclockwise as shown in FIG. 1, the top transfer receiving member P is conveyed and fed toward between the rollers of the pair of resist rollers 28. The transfer receiving member P conveyed to the pair of resist rollers 28 is stopped once at a position of the roller nip between the pair of resist rollers 28 which stops the rotation drive. The pair of resist rollers 28 are rotary driven in timing with the color image on the intermediate transfer belt 8, and the transfer receiving member P is conveyed toward the second transfer nip. Consequently a desired color image is transferred onto the transfer receiving member P.

Then, the transfer receiving member P onto which the color image is transferred at the position of the second transfer nip is conveyed to a position of a fixing portion 20. In this position the color image transferred on the surface of the transfer receiving member P is fixed onto the transfer receiving member P by heat and a pressure coming from a fixing roller and pressurizing roller. The transfer receiving member P is then discharged to the outside of the apparatus through between the rollers of a pair of paper discharging rollers 29. The transfer receiving member P discharged by the pair of paper discharging rollers 29 to the outside of the apparatus are stacked sequentially as output images on a stack portion 30.

In this manner, the line of the image formation process in the image forming apparatus is completed.

Next, the composition and operation of the developing device in the image creating portion are described in further detail with reference to FIG. 2.

The developing device 5Y is constituted by a developing roller 51Y as a developer supporting body opposed to the photosensitive drum 1Y, doctor blade 52Y opposed to the developing roller 51Y, two convey screws 55Y disposed inside developer containers 53Y and 54Y, a toner replenishing portion 58Y connected to the developer container 54Y via an opening portion, and a density detection sensor 56Y for detecting a density of the toner in the developer etc. The developing roller 51Y is constituted by a magnet fixedly installed therein, sleeve which rotates around the magnet, and the like. A two-component developer consisting of a carrier and toner is contained in the developer containers 53Y and 54Y.

The composition of the toner replenishing portion 58Y in the developing device 5Y will be described hereinbelow in detail.

The developing device 5Y configured as above operates as described below. Specifically, the sleeve of the developing roller 51Y rotates in the direction of the arrow shown in FIG. 2. The developer, which is supported on the developing roller 51Y by a magnetic field formed by the magnet, moves on the developing roller 51Y along with the rotation of the sleeve. The developer in the developing device 5Y is adjusted such that the ratio of the toner (toner density) in the developer is in a predetermined range. Specifically, the toner is replenished from a toner conveying pipe 43Y of the toner conveyance portion 40Y into the developer container 54Y via the toner replenishing portion 58Y, in accordance with toner consumption in the developing device 5Y. Then, the toner replenished into the developer container 54Y is mixed and stirred with the developer by the two conveying screws 55Y and circulate through the two developer containers 53Y and 54Y (this is a movement in the vertical direction of the paper space in FIG. 2). The toner in the developer is then absorbed to the carrier by the carrier and frictional charge, and is supported along with the carrier on the developing roller 51Y by a magnetic force formed on the developing roller 51Y.

The developer supported on the developing roller 51Y is conveyed in the direction of the arrow shown in FIG. 2 and reaches the position of the doctor blade 52Y. The developer on the developing roller 51Y is then conveyed to a position (development area) to face the photosensitive drum 1Y after the amount of the developer is regulated in this position. The toner is absorbed to the latent image by an electric field formed in the development region, the latent image being formed on the photosensitive drum 1Y. Thereafter, the developer remained on the developing roller 51Y reaches the upper part of the developer container 53Y as the sleeve rotates, and is detached from the developing roller 51Y in this position.

Next, the composition and operation of the toner conveyance portion, which feeds the toner to the developing device, will now be described with reference to the FIG. 3 to FIG. 6.

A bottle storage 31 of the toner conveyance portion is disposed on the upper side of the image forming apparatus main body 100 which described with reference to FIG. 1 earlier. There are contained four toner bottles 32Y, 32M, 32C, and 32K accommodating respective colors (yellow, magenta, cyan and black) exchangeably in the bottle storage 31. The toners with different colors contained in the toner bottles 32Y, 32M, 32C and 32K are respectively replenished into the image creating portions 6Y, 6M, 6C and 6K accordingly by the toner conveyance portion which will be described later.

Figure 3:
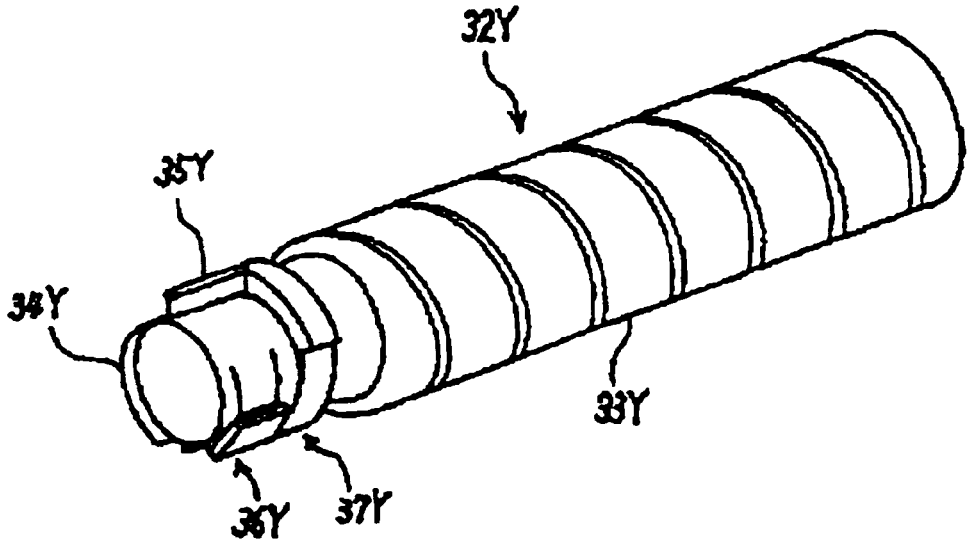
FIG. 3 is a perspective view showing an exterior appearance of a toner bottle which is installed in the image forming apparatus.
Figure 4:
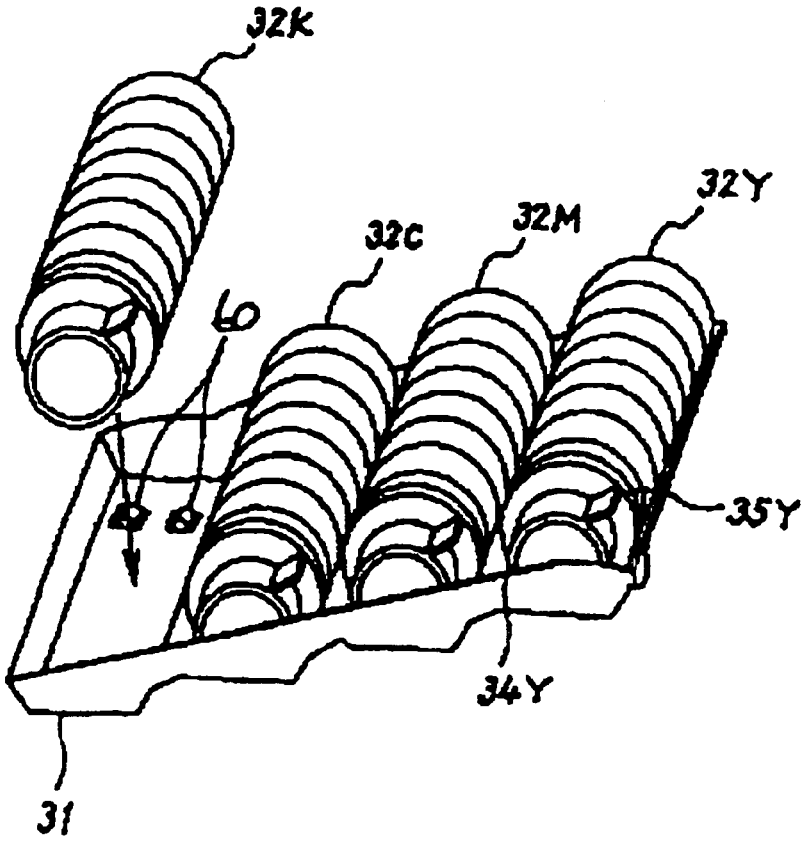
FIG. 4 is a perspective view showing a state in which the toner bottle is mounted on a bottle storage.

FIG. 3 is a perspective view showing the toner bottle 32Y. FIG. 4 is a perspective view showing a state in which the toner bottle 32K is mounted in the bottle storage 31. As shown in FIG. 3, the toner bottle 32Y is constituted by a bottle main body 33Y and a resin case 34Y provided at the tip end portion of the bottle main body 33Y. The resin case 34Y is provided, on the circumferential surface thereof, with a handle 35Y and a shutter 36Y. Further, on the resin case 34Y side, the bottle main body 33Y is provided with a gear 37Y that rotates integrally with the bottle main body 33Y.

When attaching the toner bottle 32Y to the apparatus main body 100, first, the stack portion 30 shown in FIG. 1 is opened upward to expose the bottle storage 31. Then, after mounting the toner bottle 32Y in the bottle storage 31, the handle 35Y is rotated, with reference to FIG. 4. As a result, the resin case 34Y configured integrally with the handle 35Y is rotated, the shutter 36Y is moved in the circumferential direction of the resin case 34Y, and a toner outlet (not shown) is opened. At the same time, the resin case 34Y and the bottle storage 31 are coupled with each other, whereby the position of the toner bottle 32Y on the bottle storage 31 is determined.

While on the other hand, when removing the toner bottle 32Y from the apparatus main body 100, first, the handle 35Y of the toner bottle 32Y is rotated in the reverse direction. As a result, the resin case 34Y and the bottle storage 31 are uncoupled, and the shutter 36Y is moved at the same moment, thereby closing the toner outlet. Then, the toner bottle 32Y is removed from the apparatus main body 100 while holding the handle 35Y.

The main portion of the toner conveyance portion will now be described.

Figure 5:
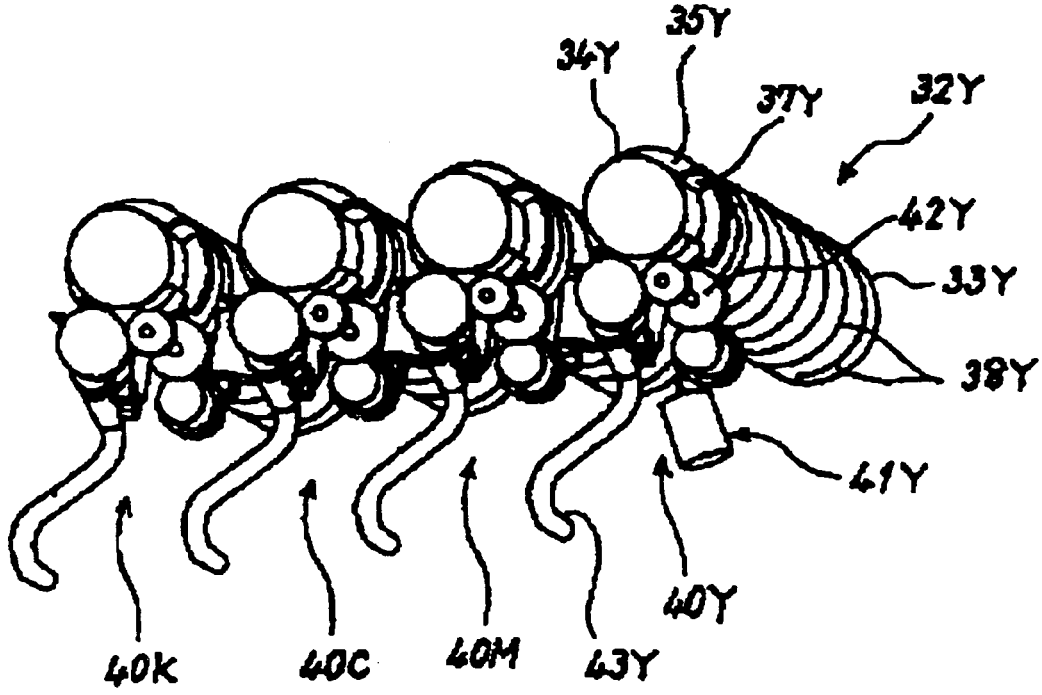
FIG. 5 is a perspective view showing a state in which the toner bottle is installed in a toner conveyance portion.
Figure 6:
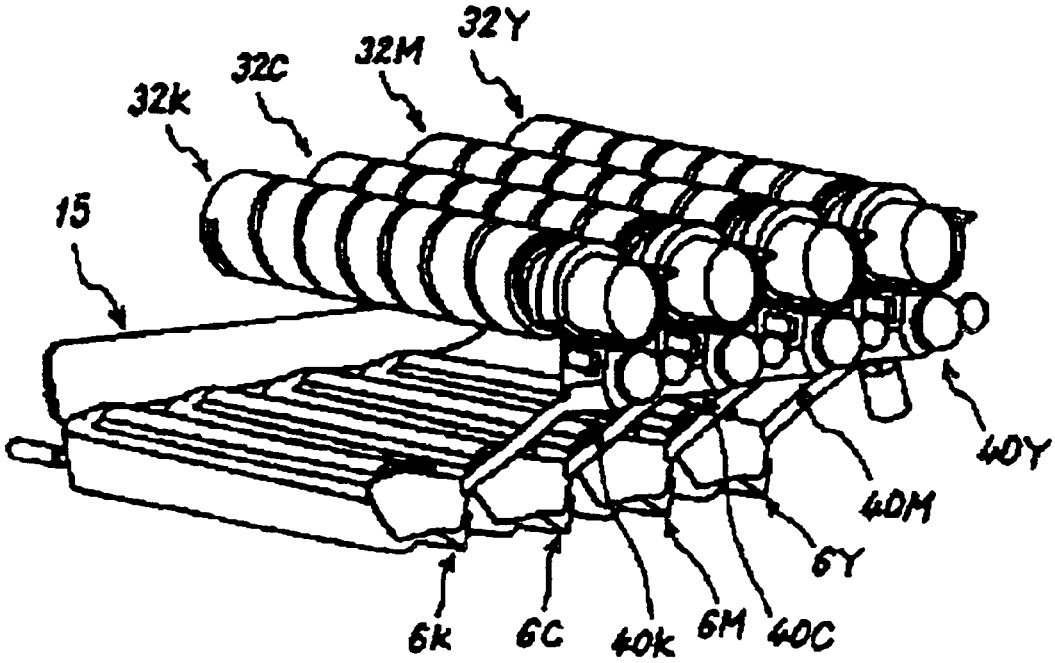
FIG. 6 is another perspective view showing a state in which the toner bottle is installed in the toner conveyance portion.

FIG. 5 is a perspective view showing from the front a state in which the toner bottles 32Y, 32M, 32C and 32K are coupled with the toner conveyance portions 40Y, 40M, 40C and 40K. FIG. 6 is a perspective view showing from the side a state in which the toner bottles 32Y, 32M, 32C and 32K are coupled with the toner conveyance portions 40Y, 40M, 40C and 40K.

The toner conveyance portions 40Y, 40M, 40C and 40K are fixedly installed on the side of the intermediate transfer unit 15 inside the apparatus main body 100. Along with this fact, the toner outlets side of the toner bottles 32Y, 32M, 32C and 32K that are connected with the toner conveyance portions 40Y, 40M, 40C and 40K, and the toner replenishing portion 58Y of the developing device 5Y are also disposed on the sides of the intermediate transfer unit 15.

The structures of the four toner conveyance portions 40Y, 40M, 40C and 40K are same except that the respective toner colors to be conveyed are different, thus the toner conveyance portion 40Y for conveyance the yellow toner is now explained. As shown in FIG. 5, the toner conveyance portion 40Y is constituted mainly by a drive motor 41Y, drive gear 42Y and a toner conveying pipe 43Y. The toner conveying pipe 43Y is provided therein with a conveying coil (not shown). The drive gear 42Y meshes with a gear 37Y of the toner bottle 32Y, and the bottle main body 33Y of the toner bottle 32Y is rotated by rotating the drive motor 41Y.

The toner is discharged by the rotation of the toner bottle 32Y in accordance with the consumption of the toner in the developing device 5Y. Specifically, when the density detection sensor 56Y of the developing device 5Y shown in FIG. 2 detects that the toner density in the toner container 54Y is insufficient, the drive motor 41Y is rotated by a signal sent from the control portion 57Y. With reference to FIG. 5, the internal surface in the bottle main body 33Y of the toner bottle 32Y has spiral grooves 38Y formed therein. Thereby, the toner is conveyed from the back of the bottle main body 33Y to the tip end on the resin case 34Y side along with the rotation of the bottle main body 33Y. The toner is then discharged from the toner outlet of the toner bottle 32Y to the outside of the bottle. With reference to FIG. 4, a roller 60 which contacts with the bottle main body 33Y is installed in the bottle storage 31 so that rotation of the toner bottle 32Y described above is made smoothly.

Thereafter, the toner discharged from the toner bottle 32Y falls onto a toner receiving portion (not shown) of the toner conveyance portion 40Y. The toner receiving portion is communicated with the toner conveying pipe 43Y. By rotating the drive motor 41Y, the bottle main body 33Y is rotated, and at the same time the conveying coil in the toner conveying pipe 43Y is rotated. Consequently, the toner that falls onto the toner receiving portion is conveyed inside the toner conveying pipe 43Y and is replenished to the toner replenishing portion 58Y of the developing device 5Y.

Next, the connection between the developing device and toner conveyance portion is explained with reference to FIG. 7 and FIG. 8.

Figure 7:
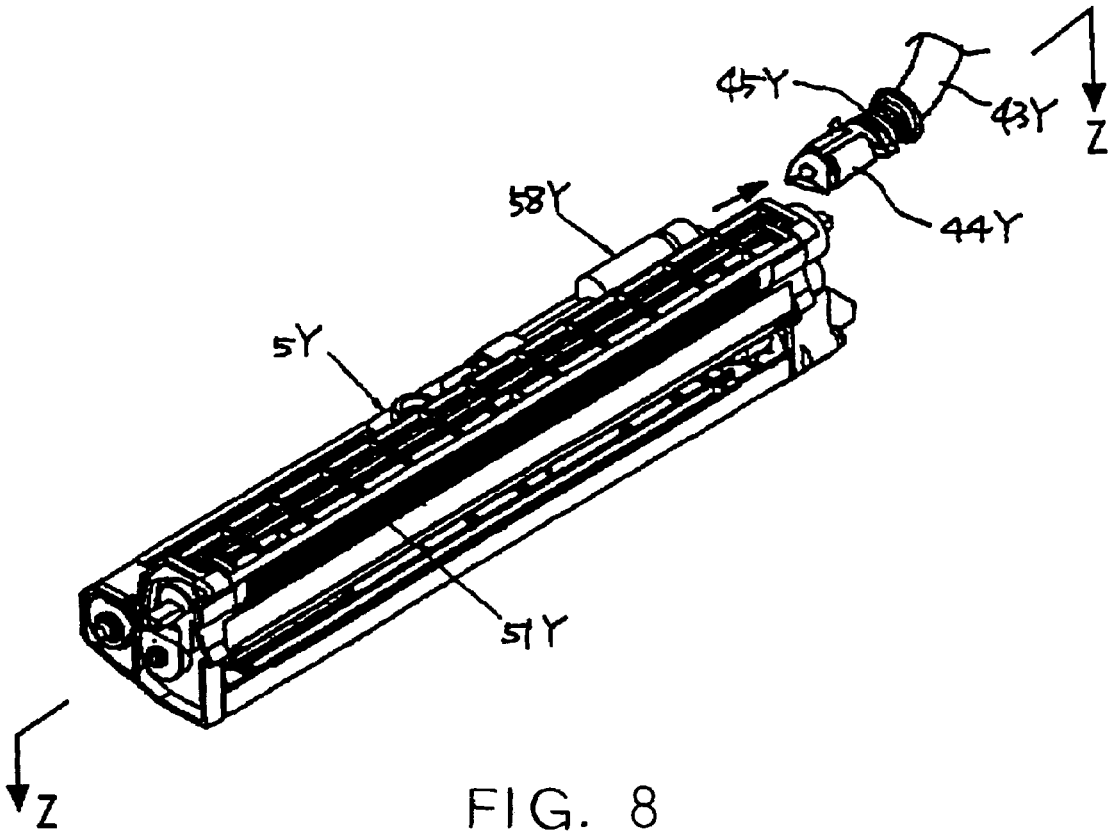
FIG. 7 is a perspective view showing a state in which a developing device is connected with the toner conveyance portion in the image forming apparatus.

FIG. 7 is a perspective view showing a state of right before the developing device 5Y being connected with the toner conveying pipe 43Y of the toner conveyance portion 40Y. FIG. 8 is a cross-sectional view (cut-away sectional view taken along the line Z-Z of FIG. 7) showing a state in which the developing device 5Y is connected with the toner conveying pipe 43Y of the toner conveyance portion 40Y.

With reference to FIG. 7, in conjunction with the attachment and detachment of the developing device 5Y to and from the apparatus main body 100, the toner replenishing portion 58Y of the developing device 5Y is brought into contact with and separated from the toner conveying pipe 43 of the apparatus main body 100. In other words, when the developing device 5Y is moved in the direction of the arrow in FIG. 7 and is attached to the apparatus main body 100, the toner conveying pipe 43Y engages with the toner replenishing portion 58Y. While on the other hand, when the developing device 5Y is moved in a reverse direction to the direction of the arrow of FIG. 7 and is detached from the apparatus main body 100, the engagement between the toner replenishing portion 58Y and toner conveying pipe 43Y is canceled.

Figure 8:
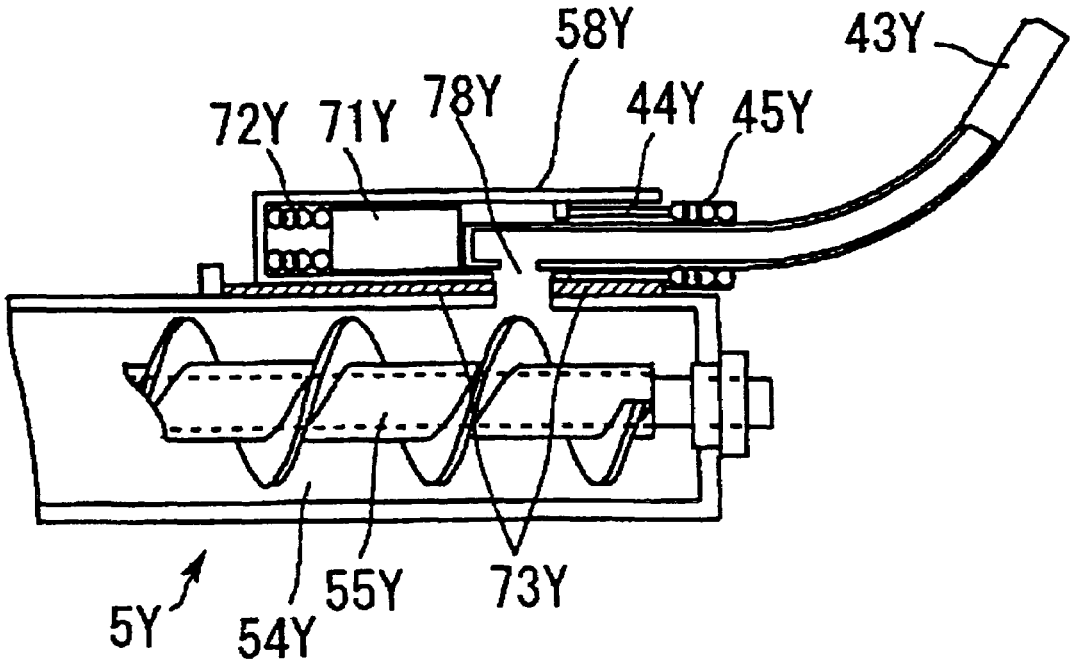
FIG. 8 is a cross-sectional view showing a state in which the developing device is connected with the toner conveyance portion.

As shown in FIG. 7 and FIG. 8, the toner replenishing portion 58Y of the developing device 5Y is provided with a shutter 71Y for opening and closing an opening portion 78Y which leads to the developer container 54Y, a spring 72Y for energizing the shutter 71Y, and the like. Further, a seal member 73Y for increasing the airtightness of the both toner replenishing portion 58Y and developer container 54Y is applied on the developer container 54Y side at a joint portion between the toner replenishing portion 58Y and developer container 54Y in order to increase the airtightness of the both. On the other hand, a pipe shutter 44Y for opening and closing the opening portion 78Y of the toner conveying pipe 43Y, and a spring 45Y for energizing the pipe shutter 44Y are installed at the tip end of the toner conveying pipe 43Y of the toner conveyance portion 40Y fixedly installed in the apparatus main body 100.

According to such a composition, the toner can be replenished from the toner conveyance portion 40Y to the developer container 54Y in a state where the toner conveying pipe 43Y is fitted to the toner replenishing portion 58Y of the developing device 5Y. Specifically, with reference to FIG. 8, when the toner conveying pipe 43Y is inserted to the toner replenishing portion 58Y, the tip end of the toner conveying pipe 43Y contacts with the shutter 71Y, and the shutter 71Y moves to the left of FIG. 8. Consequently, the toner replenishing portion 58Y and the developer container 54Y are communicated with each other via the opening portion 78Y. At the same time, the pipe shutter 44Y of the toner conveying pipe 43Y engages with a protrusion provided on an inner wall of the toner replenishing portion 58Y, the pipe shutter 44Y is locked at the position of the protrusion, and the opening portion 78Y of the toner conveying pipe 43Y is opened. Consequently, the toner conveying pipe 43Y and toner replenishing portion 58Y are communicated with each other via the opening portion 78Y. In this way, the toner can be replenished from the toner conveyance portion 40Y to the developer container 54Y.

On the other hand, when the toner conveying pipe 43Y is pulled out of the toner replenishing portion 58Y, the pressure of the shutter 71Y caused from the tip end of the toner conveying pipe 43Y is canceled, and the shutter 71Y is moved to the right of FIG. 8 by the energization force of the spring 72Y. Consequently, the opening portion 78Y between the toner replenishing portion 58Y and the developer container 54Y is closed by the shutter 71Y. In this way, the developer inside the developer container 54Y is prevented from leaking through the opening portion 78Y to the outside of the developing device 5Y. At the same time, the engagement between the pipe shutter 44Y of the toner conveying pipe 43Y and the protrusion of the toner replenishing portion 58Y is released, and the pipe shutter 44Y is moved in the direction of the tip end of the toner conveying pipe 43Y by the engaging force of the spring 45Y. Consequently, the opening portion 78Y of the toner conveying pipe 43Y is closed by the pipe shutter 44Y. In this way, the toner inside the toner conveyance portion 40Y is prevented from leaking through the opening portion 78Y of the toner conveying pipe 43Y.

Next, a sheet member 74Y, which is one of the characteristics of the present embodiment, will now be described with reference to FIG. 9 and FIG. 10.

Figure 9:
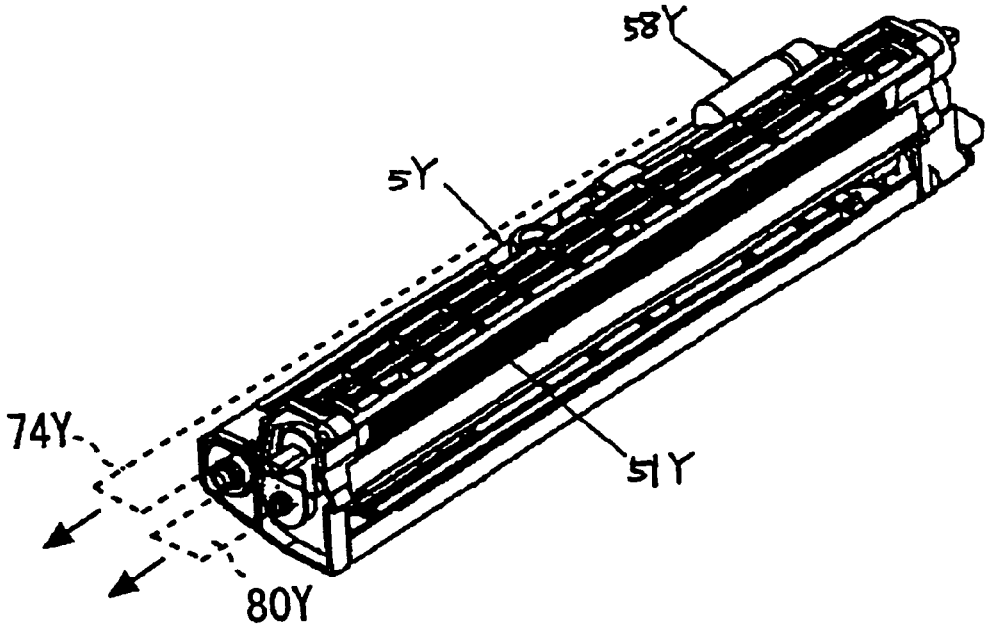
FIG. 9 is a perspective view showing a state at the time of a shipment of the developing device installed in the image forming apparatus.

FIG. 9 is a perspective view showing a state of when the developing device 5Y at the time of factory shipment. FIG. 10 is a cross-sectional view showing a state in which the developing device 5Y is included in the apparatus main body 100, and the toner replenishing portion 58Y and the toner conveyance portion 40Y are connected with each other. FIG. 10 is comparable to the above-described FIG. 8.

Figure 10:
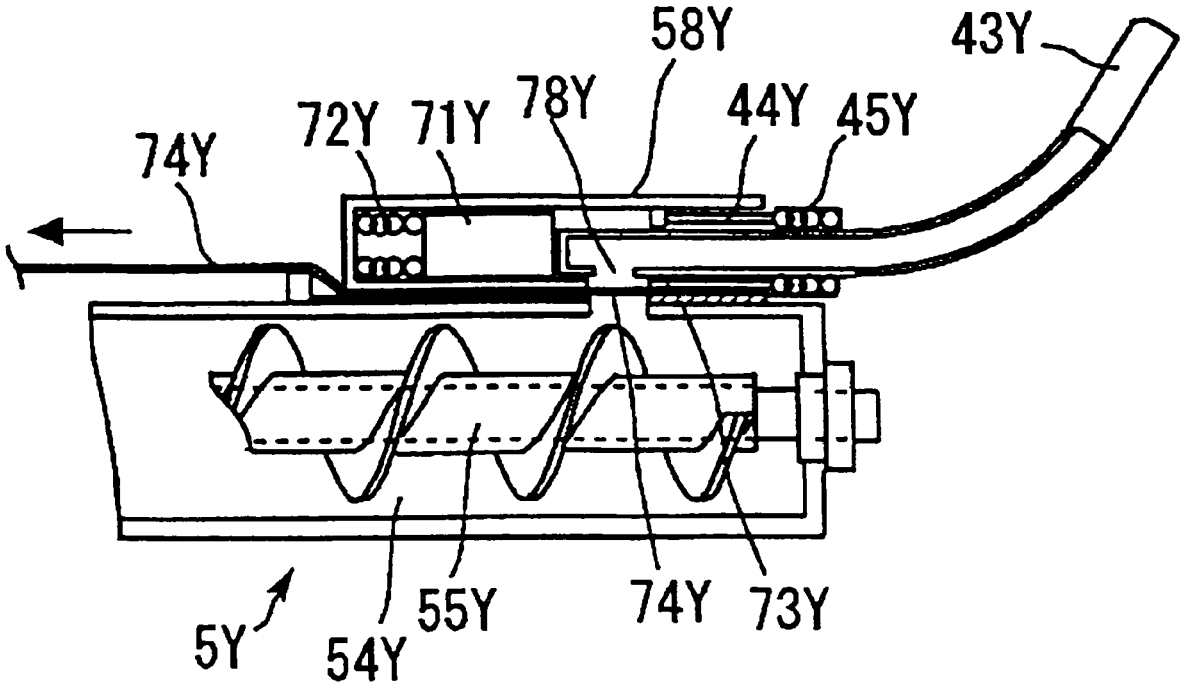
FIG. 10 is a cross-sectional view showing a state in which the developing device is included in the image forming apparatus main body.

With reference to FIG. 9 and FIG. 10, in the developing device 5Y at the time of factory shipment, the abovementioned developer is contained (preset) beforehand in the developer containers 53Y and 54Y, thereby improving work efficiency of the unpacking worker in the shipping destination. Further, when shipping out, the developing device 5Y is packed with being attached to the image forming apparatus main body 100. As a result, not only the packaging system at the time of factory shipment is simplified, but also the work efficiency of the unpacking worker in the shipping destination is improved.

Note that, by packing the developing device 5Y with being attached to the apparatus main body 100, the abovementioned toner replenishing portion 58Y and the toner conveying pipe 43Y are in contact with each other. That is, the shutter 71Y and the pipe shutter 44Y are opened, and the opening portion 78Y is left opened.

With reference to FIG. 9 and FIG. 10 as well as the positions of the broken lines in FIG. 2, a sheet member 74Y as a sealing member for sealing the abovementioned opening portion 78Y is installed in the developing device 5Y at the time of factory shipment. Specifically, the sheet member 74Y is interposed between the toner replenishing portion 58Y and the seal member 73Y of the developer container 54Y, as shown in FIG. 10. Furthermore, as shown in FIG. 9, the tip end of the sheet member 74Y protrudes to the outside the developing device 5Y and is extended to the position where the unpacking worker can pullout the sheet member 74Y. As to the material of the sheet member 74Y, a urethane material, Mylar material or the like can be used. In the sheet member 74Y, an adhesive having high releasability is applied in the circumference of the position corresponding to the opening portion 78Y. Thereby, sealability obtained when the sheet member 74Y is attached to the developing device 5Y and operationality obtained when the sheet member 74Y is pulled out of the developing device 5Y can be secured.

As above, the sheet member 74Y securely seals the opening portion 78Y, even when the developing device 5Y in which the developer is preset in the developer containers 53Y and 54Y is installed in the apparatus main body 100 and even when the shutter 71 and the pipe shutter 44Y are opened. Therefore, even when a shock is applied to the image forming apparatus during the time when it is shipped and transported to a user, it is possible to prevent the developer from flowing the toner conveying pipe 43Y backwards from the opening portion 78Y and spattering from the toner receiving portion of the toner conveyance portion 40Y.

Note that the sheet member 74Y for sealing the opening portion 78Y of the toner replenishing portion 58Y is already installed in the developing device 5Y until the image forming apparatus is shipped from the factory to a user and until use of the developing device 5Y on the apparatus main body 100 is started. When starting to use the developing device 5Y on the apparatus main body 100, the sheet member 74Y is pulled out in the direction of the arrow shown in FIG. 9 by the unpacking worker. Consequently, communication is effected between the developing device 5Y and the toner conveyance portion 40Y, whereby the development process performed by the developing device 5Y as described above is possible.

As shown in FIG. 9, the developing device 5Y at the time of shipment is provided, independently from the sheet member 74Y, with a sheet material 80Y as a second sealing member for preventing a part of the developing roller 51Y from being exposed and the developer from leaking from an opening opposed to the photosensitive drum 1Y. Specifically, as shown in FIG. 2, the second sheet member 80Y is disposed such that the space where the developer is contained is isolated from the space where the developing roller 51Y or doctor blade 52Y are installed. Further, as shown in FIG. 9, the tip end of the sheet member 80Y is protruded to the outside the developing device 5Y and extends to the position where the packaging worker can pull out the sheet member 80Y. As to the material for the sheet member 80Y, a urethane material, Mylar material or the like can be used. In the sheet member 80Y, an adhesive having high releasability is applied to a position corresponding to the case of the developing device 5Y. Thereby, sealability obtained when the sheet member 80Y is attached to the developing device 5Y and operationality obtained when the sheet member 80Y is pulled out of the developing device 5Y can be secured.

As above, the second sheet member 80Y securely seals the opening of the position of the developing roller 51Y on the developing device 5Y in which the developer is preset to the developer containers 53Y and 54Y. Consequently, even when a shock is applied during a time when the image forming apparatus is shipped from the factory and transported to a store or user, developer is prevented from spattering from the opening of the position of the developing roller 51Y, or the photosensitive drum 1Y is prevented from being damaged by the spattered developer.

As with the above-described sheet member 74Y, the second sheet member 80Y is also being installed in the developing device 5Y until the image forming apparatus is shipped from the industry to a user and until use of the developing device 5Y on the apparatus main body 100 is started. When starting to use the developing device 5Y on the apparatus main body 100, the sheet member 80Y is pulled out in the direction of the arrow shown in FIG. 9 by the unpacking worker. Consequently, the developer can be fed to the developing roller 51Y in the developer container 53Y, and the development process performed by the developing device 5Y as described above is possible.

Moreover, in the present embodiment, although the two sheet members 74Y and 80Y to be installed in the developing device 5Y at the time of factory shipment were independent members, these sheet members 74Y and 80Y can be integrated to obtain a single sheer member. In this case, the amount of man-hours for unpacking the apparatus is reduced, and work efficiency of the unpacking worker is improved.

Furthermore, in the image forming apparatus of the present embodiment, even when shipping the developing device 5Y attached to the image forming apparatus main body 100, the developing device 5Y having the developer preset therein, the sheet member 74Y is installed in the opening portion 18Y communicated with the developer container 54Y and toner replenishing portion 58Y. Thus, it is possible to provide a highly reliable developing device and image forming apparatus in which the developer is not spatter to the outside of the developing device 5Y.

Also in the present embodiment, the developing device 5Y is designed to have a composition different from the image creating member such as the photosensitive drum 1Y or the like. On the other hand, the developing device 5Y can be taken as the process cartridge in which the developing device 5Y is integrated with the image forming member such as the photosensitive drum 1Y or the like. Further, the developing device 5Y can be installed detachably to the apparatus main body 100 by integrating the developing device 5Y with at least one of the photosensitive drum 1Y, charge portion 4Y, transfer portion 15 and cleaning portion 2Y to constitute a device unit. In such a case where the process cartridge or the device unit to which the developer is preset is shipped with being attached to the image forming apparatus main body 100, the developer can be prevented from spattering to the outside of the process cartridge or device unit by installing the sheet member 74Y to the opening portion 78Y of the developing device 5Y.

As described above, in the present invention, even when the developing device to which the developer is preset is packaged in the image forming apparatus main body at the time of factory shipment, the sealing member is installed in the opening portion communicated with the developer container and toner replenishing portion, thus it is possible to provide a highly reliable developing device, process cartridge, device unit and image forming apparatus where the developer is not spatter to the outside of the developing device.

Various modifications will become possible for those skilled in the art after receiving the teachings of the present disclosure without departing from the scope thereof.

What is claimed is:

1. A developing device, detachably arranged in a main body of an image forming apparatus having a toner conveyance portion formed with a hole portion and equipped with a hole portion shutter for opening and closing the hole portion, the developing device comprising:

a developer container for containing a developer;

a toner replenishing portion configured to detachably connect with the toner conveyance portion and to communicate with the developer container via an opening portion to supply the developer container with toner;

wherein the toner replenishing portion is provided above the developer container and is equipped with an opening portion shutter for opening and closing the opening portion, such that the opening portion shutter opens or closes the opening portion and, at the same time, the hole portion shutter opens or closes the hole portion of the toner conveyance portion, respectively;

a removable sealing member for sealing the opening portion until the developing device is used on the main body; and a removable second sealing member for isolating a space where the developer is contained from an adjacent space where a developing roller is installed, until use of the developing device on the main body is started.

2. The developing device as claimed in claim 1, wherein the space is formed between the developer container and the adjacent space such that the developer circulates through the space and the developer container.

3. The developing device as claimed in claim 2, wherein the space constitutes a second developer container.

4. An image forming apparatus, wherein a main body of the image forming apparatus is equipped with a developing device, the developing device comprising:

a developer container for containing a developer;

a toner conveyance portion installed in the main body and connected with a toner replenishing portion, the toner conveyance portion being configured to supply toner to the toner replenishing portion which is communicated with the developer container via an opening portion to supply the developer container with toner, wherein the toner replenishing portion is provided above the developer container and is equipped with a first shutter for opening and closing the opening portion, and wherein the toner conveyance portion is formed with a hole portion and equipped with a second shutter for opening and closing the hole portion such that the first shutter opens or closes the opening portion and, at the same time, the second shutter opens or closes the hole portion of the toner conveyance portion, respectively;

a removable sealing member for sealing the opening portion until the developing device is used on the main body; and a removable second sealing member for isolating a space where the developer is contained from an adjacent space where a developing roller is installed, until use of the developing device on the main body is started.

5. The image forming apparatus as claimed in claim 4, wherein the space is formed between the developer container and the adjacent space such that the developer circulates through the space and the developer container.

6. The image forming apparatus as claimed in claim 5, wherein the space constitutes a second developer container.

7. A process cartridge for use in an image forming apparatus having an image supporting body, a developing device and a toner conveyance portion formed with a hole portion and equipped with a hole portion shutter for opening and closing the hole portion, wherein the developing device and the image supporting body are integrated, and the process cartridge being installed detachably to a main body of the image forming apparatus, the process cartridge comprising:

a developer container for containing a developer;

a toner replenishing portion configured to detachably connect with the toner conveyance portion and to communicate with the developer container via an opening portion to supply the developer container with toner;

wherein the toner replenishing portion is provided above the developer container and is equipped with an opening portion shutter for opening and closing the opening portion, such that the opening portion shutter opens or closes the opening portion and, at the same time, the hole portion shutter opens or closes the hole portion of the toner conveyance portion, respectively;

a removable sealing member for sealing the opening portion until the developing device is used on the main body; and a removable second sealing member for isolating a space where the developer is contained from an adjacent space where a developing roller is installed, until use of the developing device on the main body is started.

8. The process cartridge as claimed in claim 7, wherein at least one of a charge portion for charging the top of the image supporting body and a cleaning portion for cleaning on the image supporting body is further integrated with the process cartridge.

9. The process cartridge as claimed in claim 8, wherein the space is formed between the developer container and the adjacent space such that the developer circulates through the space and the developer container.

10. The process cartridge as claimed in claim 9, wherein the space constitutes a second developer container.

11. An image forming apparatus, comprising:

a main body equipped with a process cartridge having an image supporting body and a developing device, wherein the developing device and the image supporting body are integrated, the process cartridge being installed detachably to the main body;

a developer container for containing a developer;

a toner conveyance portion installed in the main body and connected with a toner replenishing portion, the toner conveyance portion being configured to supply toner to the toner replenishing portion which is communicated with the developer container via an opening portion to supply the developer container with toner, wherein the toner replenishing portion is provided above the developer container and is equipped with a first shutter for opening and closing the opening portion, and wherein the toner conveyance portion is formed with a hole portion and equipped with a second shutter for opening and closing the hole portion such that the first shutter opens or closes the opening portion and, at the same time, the second shutter opens or closes the hole portion of the toner conveyance portion, respectively;

a removable sealing member for sealing the opening; and a removable second sealing member for isolating a space where the developer is contained from an adjacent space where a developing roller is installed, until use of the developing device on the main body is started.

12. The image forming apparatus as claimed in claim 11, wherein the space is formed between the developer container and the adjacent space such that the developer circulates through the space and the developer container.

13. The image forming apparatus as claimed in claim 12, wherein the space constitutes a second developer container.

14. A device unit which is installed detachably to a main body of an image forming apparatus including a toner conveyance portion formed with a hole portion and equipped with a hole portion shutter for opening and closing the hole portion, the device unit being equipped with a developing device, the developing device comprising:

a developer container for containing a developer;

a toner replenishing portion configured to detachably connect with the toner conveyance portion and to communicate with the developer container via an opening portion to supply the developer container with toner;

wherein the toner replenishing portion is provided above the developer container and is equipped with an opening portion shutter for opening and closing the opening portion such that the opening portion shutter opens or closes the opening portion and, at the same time, the hole portion shutter opens or closes the hole portion of the toner conveyance portion, respectively;

a removable sealing member for sealing the opening portion until the developing device is used on the main body; and a removable second sealing member for isolating a space where the developer is contained from an adjacent space where a developing roller is installed, until use of the developing device on the main body is started;

wherein at least one of an image supporting body, charge portion for charging the top of the image supporting body, transfer portion for transferring a toner image formed on the image supporting body to a transfer receiving material, and cleaning portion for cleaning on said image supporting body is integrated with the developing device.

15. An image forming apparatus having a main body is equipped with a device unit which is installed detachably to the main body and is equipped with a developing device, the developing device comprising:

a developer container for containing a developer;

a toner conveyance portion installed in the main body and connected with a toner replenishing portion, the conveyance portion being configured to supply toner to the toner replenishing portion which is communicated with the developer container via an opening portion to supply the developer container with toner, wherein the toner replenishing portion is provided above the developer container and is equipped with a first shutter for opening and closing the opening portion, and wherein the toner conveyance portion is formed with a hole portion and equipped with a second shutter for opening and closing the hole portion such that the first shutter opens or closes the opening portion and, at the same time, the second shutter opens or closes the hole portion of the toner conveyance portion, respectively;

a removable sealing member for sealing the opening portion until the developing device is used on the main body; and a removable second sealing member for isolating a space where the developer is contained from an adjacent space where a developing roller is installed, until use of the developing device on the main body is started;

wherein at least one of an image supporting body, charge portion for charging the top of the image supporting body, transfer portion for transferring a toner image formed on the image supporting body to a transfer receiving material, and cleaning portion for cleaning on the image supporting body is integrated with the developing device.

16. A developing device detachably arranged in a main body of an image forming apparatus having a toner conveyance portion formed with a hole portion and equipped with a hole portion shutter for opening and closing the hole portion, the developing device comprising:

a developer container for containing a developer;

an opening portion for supplying the developer container with toner;

a toner replenishing portion configured to detachably connect with the toner conveyance portion and to communicate with the developer container via the opening portion to supply the developer container with toner;

wherein the toner replenishing portion is provided above the developer container and is equipped with an opening portion shutter for opening and closing the opening portion, such that the opening portion shutter opens or closes the opening portion and, at the same time, the hole portion shutter opens or closes the hole portion of the toner conveyance portion, respectively;

a removable sealing member set between the opening portion shutter and the opening portion for sealing the opening portion until the developing device is used on the main body; and a removable second sealing member for isolating a space where the developer is contained from an adjacent space where a developing roller is installed, until use of the developing device on the main body is started.

17. The developing device as claimed in claim 16, wherein the space is formed between the developer container and the adjacent space such that the developer circulates through the space and the developer container.

18. The developing device as claimed in claim 17, wherein the space constitutes a second developer container.

19. The developing device as claimed in claim 16, wherein the opening portion is provided above the developing container and in the vicinity of the end of the developing container in the longitudinal direction thereof.

20. The developing device as claimed in claim 19, further comprising a seal member provided on the periphery of the opening portion in a manner as to be in contact with the lower portion of the removable sealing member.

21. The developing device as claimed in claim 20, wherein the opening portion shutter is configured to open the opening portion when the opening portion shutter is moved to the center of the developer container in the longitudinal direction thereof.

22. An image forming apparatus, wherein a main body of the image forming apparatus is equipped with a developing device, the developing device comprising:

a developer container for containing a developer;

an opening portion for supplying the developer container with toner;

a first shutter for opening and closing the opening portion, wherein a toner conveyance portion installed in the main body supplies toner to the developer container via the opening portion when the first shutter is opened;

a removable sealing member set between the first shutter and the opening portion for sealing the opening portion until the developing device is used on the main body; and a removable second sealing member for isolating a space where the developer is contained from an adjacent space where a developing roller is installed, until use of the developing device on the main body is started.

23. The image forming apparatus as claimed in claim 22, wherein the toner conveyance portion is formed with a hole portion and equipped with a second shutter such that the first shutter opens or closes the opening portion and, at the same time, the second shutter opens or closes the hole portion of the toner conveyance portion, respectively.

24. The image forming apparatus as claimed in claim 23, wherein the space is formed between the developer container and the adjacent space such that the developer circulates through the space and the developer container.

25. The image forming apparatus as claimed in claim 24, wherein the space constitutes a second developer container.

26. The image forming apparatus as claimed in claim 25, wherein the opening portion is provided above the developing container and in the vicinity of the end of the developing container in the longitudinal direction thereof.

27. The image forming apparatus as claimed in claim 26, further comprising a seal member provided on the periphery of the opening portion in a manner as to be in contact with the lower portion of the removable sealing member.

28. The forming apparatus as claimed in claim 27, wherein the first shutter is configured to open the opening portion when the first shutter is moved to the center of the developer container in the longitudinal direction thereof.

29. A process cartridge for use in an image forming apparatus having an image supporting body, a developing device and a toner conveyance portion formed with a hole portion and equipped with a hole portion shutter for opening and closing the hole portion, wherein the developing device and the image supporting body are integrated, and the process cartridge being installed detachably to a main body of the image forming apparatus, the process cartridge comprising:

a developer container for containing a developer;

a toner replenishing portion configured to detachably connect with the toner conveyance portion and to communicate with the developer container via an opening portion to supply the developer container with toner;

wherein the toner replenishing portion is provided above the developer container and is equipped with an opening portion shutter for opening and closing the opening portion, such that the opening portion shutter opens or closes the opening portion and, at the same time, the hole portion shutter opens, or closes the hole portion of the toner conveyance portion, respectively;

a removable sealing member set between the opening portion shutter and the opening portion for sealing the opening portion until the developing device is used on the main body; and a removable second sealing member for isolating a space where the developer is contained from an adjacent space where a developing roller is installed, until use of the developing device on the main body is started.

30. The process cartridge as claimed in claim 29, wherein the space is formed between the developer container and the adjacent space such that the developer circulates through the space and the developer container.

31. The process cartridge as claimed in claim 30, wherein the space constitutes a second developer container.

32. The process cartridge as claimed in claim 31, wherein the opening portion is provided above the developing container and in the vicinity of the end of the developer container in the longitudinal direction thereof.

33. The process cartridge as claimed in claim 32, further comprising a seal member provided on the periphery of the opening portion in a manner as to be in contact with the lower portion of the removable sealing member.

34. The process cartridge as claimed in claim 33, wherein the opening portion shutter is configured to open the opening portion when the opening portion shutter is moved to the center of the developer container in the longitudinal direction thereof.

35. An image forming apparatus comprising:

a main body equipped with a process cartridge having an image supporting body and a developing device, wherein the developing device and the image supporting body are integrated, the process cartridge being installed detachably to the main body;

a developing container for containing a developer;

an opening portion for supplying the developer container with toner;

a first shutter for opening and closing the opening portion, wherein a toner conveyance portion installed in the main body supplies toner to the developer container via the opening portion when the first shutter is opened;

a removable sealing member set between the first shutter and the opening portion for sealing the opening portion until the developing device is used on the main body; and a removable second sealing member for isolating a space where the developer is contained from an adjacent space where a developing roller is installed, until use of the developing device on the main body is started.

36. The image forming apparatus as claimed in claim 35, wherein the toner conveyance portion is formed with a hole portion and equipped with a second shutter such that the first shutter opens or closes the opening portion and, at the same time, the second shutter opens or closes the hole portion of the toner conveyance portion, respectively.

37. The image forming apparatus as claimed in claim 36, wherein the space is formed between the developer container and the adjacent space such that the developer circulates through the space and the developer container.

38. The image forming apparatus as claimed in claim 37, wherein the space constitutes a second developer container.

39. The image forming apparatus as claimed in claim 38, wherein the opening portion is provided above the developing container and in the vicinity of the end of the developer container in the longitudinal direction thereof.

40. The image forming apparatus as claimed in claim 39, further comprising a seal member provided on the periphery of the opening portion in a manner as to be in contact with the lower portion of the removable sealing member.

41. The image forming apparatus as claimed in claim 40, wherein the first shutter is configured to open the opening portion when the first shutter is moved to the center of the developer container in the longitudinal direction thereof.

* * * * *